US008881440B2

(12) United States Patent
Shavelkin

(10) Patent No.: US 8,881,440 B2
(45) Date of Patent: Nov. 11, 2014

(54) DEVICE FOR PRESENTING INFORMATION AND FRAME FOR IT

(76) Inventor: Yry Alekseevich Shavelkin, Zarechny (RU)

( * ) Notice: Subject to any disclaimer, the term of this patent is extended or adjusted under 35 U.S.C. 154(b) by 0 days.

(21) Appl. No.: 13/879,393

(22) PCT Filed: Apr. 27, 2011

(86) PCT No.: PCT/RU2011/000274
§ 371 (c)(1),
(2), (4) Date: Apr. 13, 2013

(87) PCT Pub. No.: WO2012/053930
PCT Pub. Date: Apr. 26, 2012

(65) Prior Publication Data

US 2013/0192109 A1 Aug. 1, 2013

(30) Foreign Application Priority Data

Oct. 20, 2010 (RU) ..... 2010142944

(51) Int. Cl.
*G09F 17/00* (2006.01)
*G09F 15/00* (2006.01)

(52) U.S. Cl.
CPC ..... *G09F 15/0025* (2013.01)
USPC ..... 40/603; 38/102.1

(58) Field of Classification Search
USPC ..... 40/603, 604, 711; 38/102, 102.1, 102.4, 38/102.91
See application file for complete search history.

(56) References Cited

U.S. PATENT DOCUMENTS

| | | | | |
|---|---|---|---|---|
| 1,726,545 | A * | 9/1929 | Dixon | 40/603 |
| 5,669,166 | A * | 9/1997 | Verret | 40/603 |
| 6,309,076 | B1 * | 10/2001 | McVicker | 359/601 |
| 6,495,238 | B1 * | 12/2002 | Campbell | 428/121 |
| 6,760,990 | B2 * | 7/2004 | Lowndes | 40/603 |
| 6,862,825 | B1 * | 3/2005 | Lowndes | 40/603 |
| 7,178,281 | B2 * | 2/2007 | Johansson et al. | 40/603 |
| 7,207,128 | B2 * | 4/2007 | Cook | 40/603 |
| 2002/0029504 | A1 * | 3/2002 | Lowndes | 40/603 |
| 2004/0205992 | A1 * | 10/2004 | Devaney | 40/590 |
| 2004/0237365 | A1 * | 12/2004 | Johansson et al. | 40/603 |

FOREIGN PATENT DOCUMENTS

| | | | |
|---|---|---|---|
| JP | 2003248450 | A | 9/2003 |
| RU | 7237 | U1 | 7/1998 |
| RU | 50917 | U1 | 1/2006 |
| RU | 62396 | U1 | 4/2007 |
| RU | 69679 | U1 | 12/2007 |

* cited by examiner

*Primary Examiner* — Gary Hoge
(74) *Attorney, Agent, or Firm* — Nadya Reingand; Yan B. Hankin

(57) ABSTRACT

This invention relates to the field of advertising and information display. It can be used in the production of portable advertising and information media with flexible supports, transported easily, and installed quickly to display any visual information. The invention ensures high-quality and effective tensioning of the panel over the course of a long use period including multiple relocations. The device for presenting information comprises a panel mounted on a sectional frame with rotating edges of the panel mounted on the sides of the frame. Each of the rotatable edges consists of at least two layers: the panel itself and a facing applied to the panel in its pre-tensioned resiliently deformed state, thus retaining the tension of the panel material attached to the facing. The panel is mounted on a frame in a state of resiliently extended deformation and is fixed with edges supported in pairs on the frame.

12 Claims, 6 Drawing Sheets

DEVICE FOR PRESENTING INFORMATION AND FRAME FOR IT

CROSS-REFERENCE TO RELATED APPLICATIONS

This invention claims priority to, and incorporates by reference PCT Patent application PCT/RU2011/000274 filed Apr. 27, 2011 based on Russian patent application RU2010142944 filed Oct. 20, 2010, now issued as Russian patent No. 2454734.

FIELD OF THE INVENTION

The claimed invention relates to the field of advertising and information display. It can be used in the production of portable advertising and information media with flexible supports, which can be transported easily and installed quickly in various locations and used for arranging a decorative and artistic outdoor presentation, as well as advertisements for goods and services, posters, notices, or any other visual information.

BACKGROUND OF THE INVENTION

During advertisement or information display installation, which is implemented on flexible carriers (e.g. banner fabric, banner construction net, canvas) banner tightening problems arise.

There are various known products with devices for tightening banners, e.g. RU No. 7237, 28003, 32310, 45847, 53059, 69669, 69670, 70036, 74879, 76056, 90995, 2209024, 2259431, 2200981.

Several devices for presenting information are known in the prior art. One known device for presenting information comprises a billboard, implemented in the form of a closed rectangular contour with a central rectangular opening, flexible advertisement carrier (banner) equipped along a peripheral area with a consecutive row of openings, with a corresponding number of extension springs installed, equipped with a loop for interacting with openings/holes in the advertisement carrier (RU No 46878).

Another known device for presenting information comprises an advertising setup, consisting of a flexible carrier (banner), with solid stiffening ribs on opposite edges, and at least two mounting brackets with guiding elements in the form of lugs and/or blocks. One of the stiffening ribs is connected to the extreme guiding element of the lower mounting element of the dampening device. The edge of the advertisement carrier, having no stiffening ribs, contains eyelets and/or snap hooks (RU 32310).

Another known device for presenting information comprises a stretchable banner, including a banner cloth and supporting elements. The supporting elements are in the form of a closed contour which limits the banner area, held by the tension mechanisms, located along the perimeter of the closed contour. The closed contour is in the form of a rigid rectangular frame (RU No 45847).

Another known device for presenting information comprises a means for displaying advertisements, consisting of a carrier, for which a wall of a building or structure is used, and an advertisement-information device, in the form of stretched banner cloth, tied to the carriers using brackets, with the banner cloth enclosed in a frame, equipped with a tension mechanism, attached to the brackets, with each side of the cloth containing pockets along the perimeter for inserting frame tubes (RU No 53059).

Another known device for presenting information comprises an advertising setup, consisting of an advertisement carrier, made of flexible material (cloth) and having stiffening ribs on opposite edges, a mounting element such as a bracket, and a tensioning system. The tensioning system connects the stiffening ribs to the brackets and is made of two pairs of blocks, including passing and lifting blocks, through which runs a cable, the ends of which are attached to the passing blocks, with the tension spring attached to the cable, positioned on the area of cable between passing blocks (RU No 69670).

Another known device for presenting information in the billboard form, most similar to the claimed invention, comprises a frame, a panel for the information display device made of flexible material, and means for tensioning and securing it to the frame. The means for tensioning and securing the cloth to the flexible material on the frame is comprised of one rod, at least one clamp, and at least one means for fixation in respect to the frame. The rod is connected to the clamp by the part of the panel made of flexible material, located on the edge, and the clamp contains a means of holding the rod together with the aforementioned part of the panel made of flexible material (RU No. 7237, prototype).

A disadvantage of all the known prior art is the need to adjust tensioning of the panel material during every installation of the panel onto the frame, through the use of specialized devices. This requires highly qualified installation personnel and is associated with large labor costs and low quality installation. It also limits the number of cycles for which the panel can be used and the possibility for multiple device relocations, since excessive wear on the panel and frame are associated with each assembly procedure. These devices also do not provide uniform tension of the advertisement carrier's panel.

The disadvantages of all known prior art are characterized by assumptions of the need to create tensile forces where the panel mounts with vectors directed out from the center of the panel, while simultaneously providing tensile strength directed from the center of the panel to the periphery. This is a technically difficult task, entailing the need for transporting and using complex and bulky equipment at the operation site.

SUMMARY OF THE INVENTION

The essence of this invention comprises a panel, mounted on a sectional frame, with the rotating edges of the panel mounted on the sides of said frame. Each of the rotating edges is formed with a structure consisting of at least two-layers. These rotating edges consist of a facing (material which is harder relative to the panel material) applied to the material of the panel in the pre-tensioned resiliently deformed state thereof and affixed thereto whilst retaining the tension of the faced material of the panel at a fixing point. The panel is mounted on the frame in a state of resiliently extended deformation and is fixed with edges supported in pairs on the frame.

Preferably, the edges are angled in relation to the panel surface. The frame is made of collapsible linear segments. The frame has steps along the edges and provides the ability to hem the edges on the rear or display side of the panel. The sides of the frame have parallel steps and grooves, whose outer edges are separated by a width which is less than the width of the edge of the panel.

In particular cases, the frame is made with provision for additional tensioning of the panel by increasing the distance between its sides.

DETAILED DESCRIPTION OF THE PREFERRED EMBODIMENT

The technical objective of this invention, employing a singular creative intent, is the design and production of effective devices for presenting information (i.e. panels) and frames, for them, as well as the expansion of the toolbox of devices for presenting information and frames for them.

The technical result, which fulfills the stated objective once the invention is implemented, ensures high-quality, multiple and effective tensioning of the panel over a long period of extended use, decreasing the need for qualified installation personnel, reducing labor costs due to transport and installation, while also ensuring high quality tensioned panel installation. This ensures high quality, uniform panel tensioning of devices for presenting information, including informational, decorative, and advertising billboards.

The essence of this invention comprises a panel, mounted on a sectional frame, with the rotating edges of the panel mounted on the sides of said frame. Each of the rotating edges is formed with a structure consisting of at least two-layers. These rotating edges consist of a facing (material which is harder relative to the panel material) applied to the material of the panel in the pre-tensioned resiliently deformed state thereof and affixed thereto whilst retaining the tension of the faced material of the panel at a fixing point. The panel is mounted on the frame in a state of resiliently extended deformation and is fixed with edges supported in pairs on the frame.

Preferably, the edges are angled in relation to the panel surface. The frame is made of collapsible linear segments. The frame has steps along the edges and provides the ability to hem the edges on the rear or display side of the panel. The sides of the frame have parallel steps and grooves, whose outer edges are separated by a width which is less than the width of the edge of the panel.

Figure 4:
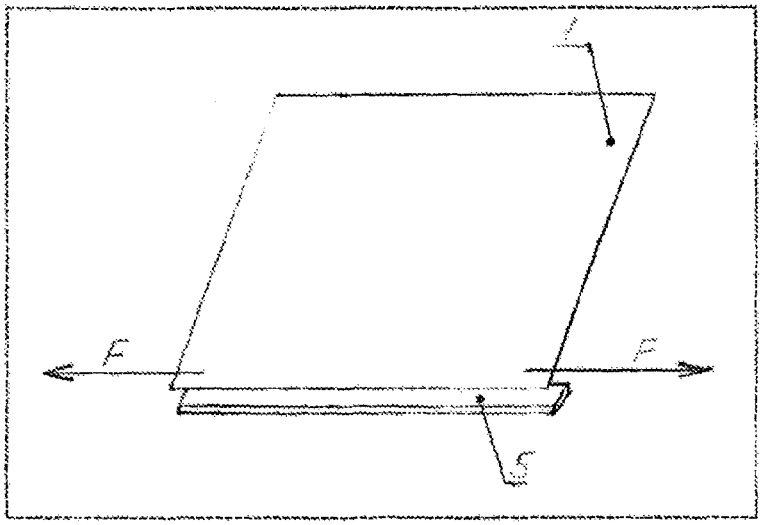
FIG. 4 displays the design schematic of local pre-tensioning (F) of the panel (1) prior to applying facing (5) to the panel.
Figure 5:
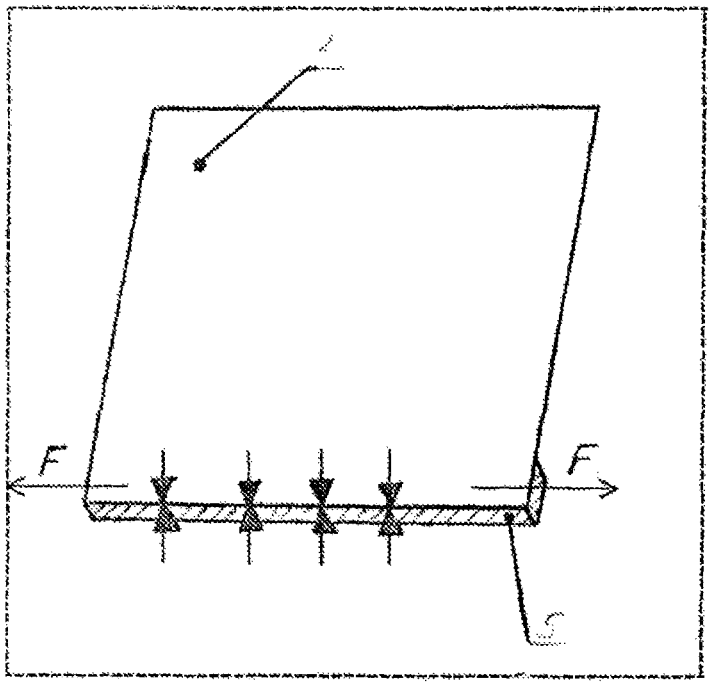
FIG. 5 illustrates the design schematic for applying facing (5) to the panel (1). In this figure, the mirrored arrows indicate the direction of affixing during attachment of the panel (1) to the facing (5).
Figure 6:
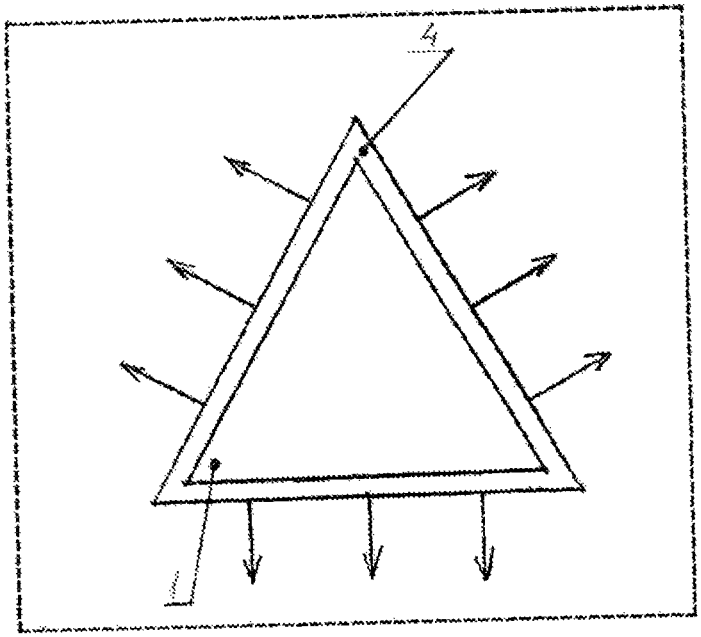
Figure 7:
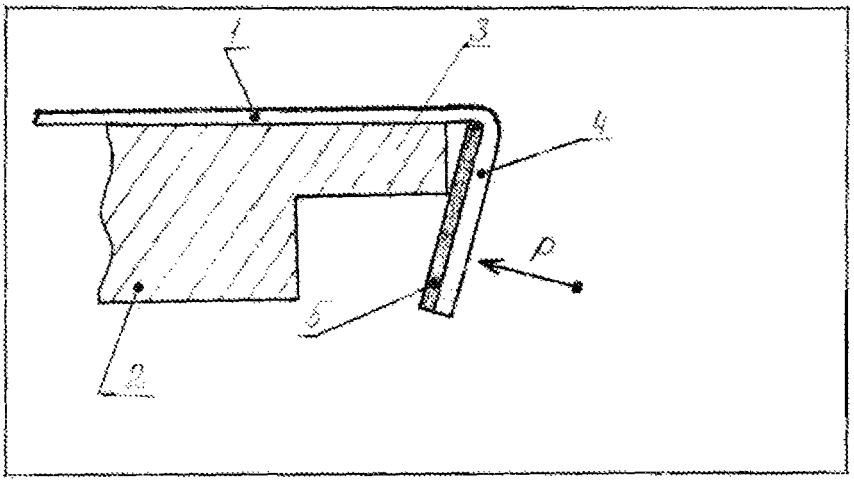
FIG. 7 shows the construction schematic for mounting the panel (1) to the frame (2) with rotating edges (4) angled under the ledge (3) of the frame.
Figure 8:
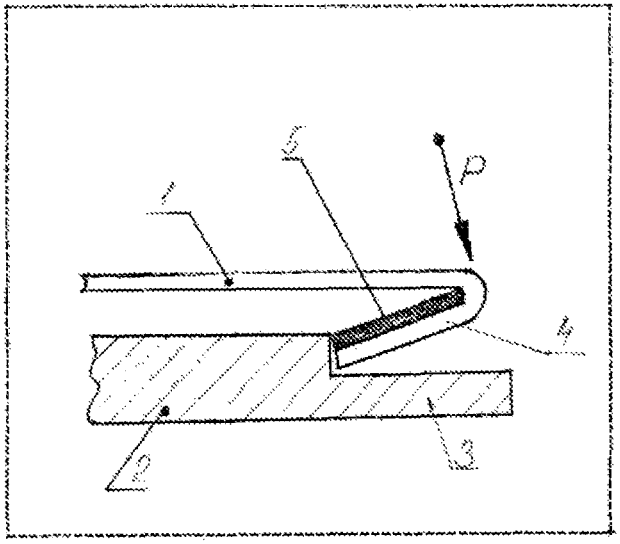
FIG. 8 illustrates the design schematic for mounting the panel (1) to the installation frame (2) with an edge rotation of 180° on the ledge (3) of the frame.
Figure 9:
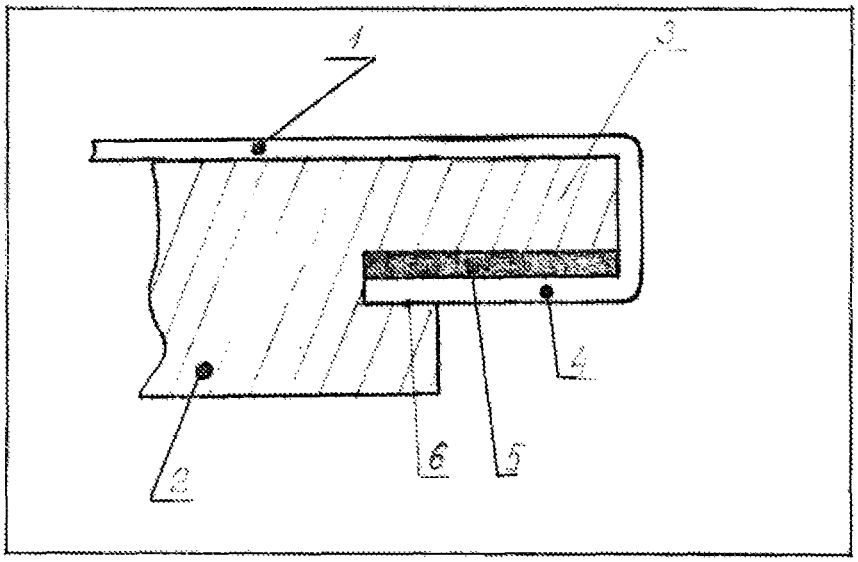
FIG. 9 illustrates the design schematic for mounting the panel (1) on the frame (2) with an edge rotation of 180° under the ledge (3) of the frame and subsequent fixation.

In particular cases, the facing applied to the back or front sides of the panel material to form edges is implemented to function as a lever-strut and lock during tensioning of the panel on the frame (e.g. a grooved material, see the inset (100) in FIG. 4). The facing is made of continuous or multiple segments and is mounted to the panel material using either quick-set polyurethane hot glue or another quick-set glue with similar properties, double-sided tape, or high-frequency welding.

Figure 2:
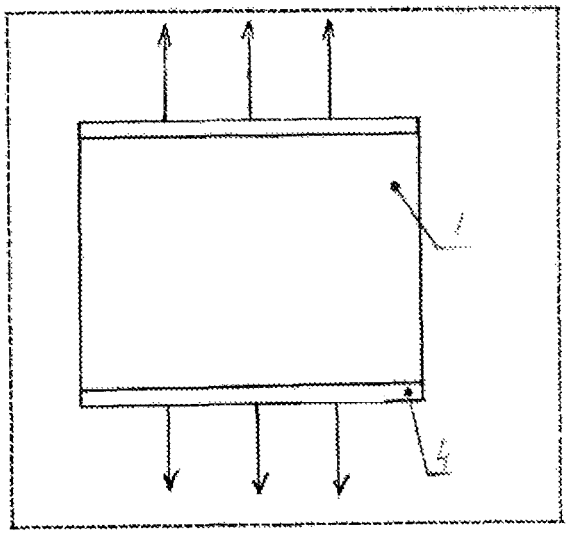
Figure 3:
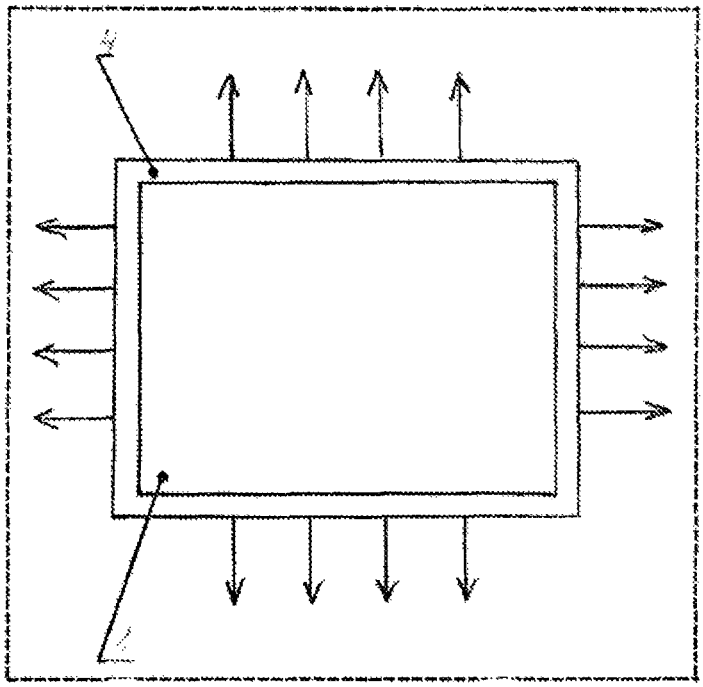

The device for presenting information contains a panel (1) mounted on the multipart frame (2) (equivalent to a frame or any term for framework or fixture for mounting panels). The sides of the frame (2) have ledges (3), to which parallel rotating edges (4) are attached, positioned in opposite (i.e. complementary) pairs along the sides of the panel (1). In some embodiments, the edges (4) may be curved. Every edge (4) is a structure comprised of at least two-layers, in the form of a ratcheted facing (5) applied to the reverse side of the material of the panel (1) in the pre-tensioned resiliently deformed state thereof and affixed thereto whilst retaining the tension of the faced material of the panel at a fixing point. (See FIG.2, the arrows (F) show the forces of tension applied to allows the panel to be pre-tensioned in a resiliently deformed state prior to application of the facing (5)). When the device for presenting information is assembled, the tensioned panel (1) is supported on the frame (2) by edges (4) serving the function of lever-spacers and clamps during tensioning of the panel on the frame.

The term "edge" (4) in this case refers to a narrow strip of material along the edge of the panel (1), which has a facing (5) applied on at least one side, i.e. a layer of different material. Therefore, the first layer of the two-layered edge is a facing (5), and the second layer is the panel (1) material. This does not exclude applying facing on two sides, in which case the edge (4) will consist of three (3) layers.

The frame (2) is implemented (e.g. rectangular) with a distance between the outer edges of ledges (3) along the sides greater than the distance between the inner edges (with respect to the center of the panel (1) of the corresponding edges (4) (after deducting from this distance the total thickness of two ledges (3) and the thickness of two facings (5)), preferably, by a permissible amount of resilient deformation of the panel (1). In this case, the edges of the ledges (3) are the sides of the frame that support the corresponding edge (4). In the frame (2), the ledges (3) and grooves (6) can be parallel, with their inner edges separated by a distance of less than the width of the edge (4).

In particular embodiments, the frame (2) can be made in the form of 2+n where 'n' is an integer greater than or equal to 1 ($n \geq 1$), with a distance between the outer edges of ledges (3) along the sides greater than the distance between the inner edges (with respect to the center of the panel (1) of the corresponding edges (4) (after deducting from this distance the total thickness of two ledges (3) and the thickness of two facings (5)), preferably by a permissible amount of resilient deformation of the panel (1).

The frame (2) can be designed to allow additional panel (1) tension by increasing the distance between its sides.

Overall, this device for presenting information can take the form of a banner, poster, mural, etc. In this case, the presented information is visual, i.e., the presentation form or transfer of information includes textual images—transmitted in the form of alphabet characters, digits, and symbols, and/or graphics—as well as artistic/visual—any other images including objects, graphics, etc.—or a combination of textual/artistic/visual images.

The frame (2) can be designed and adjusted to allow additional panel (1) tension by increasing the distance between its sides. This can be done, for example, by adding or removing straight line frame segments (101), thus making the frame larger and creating more tension when the panel is mounted.

The ledge (3) on the edges of the frame (2) can be implemented to allow hemming of the edge (4) on the reverse (back) side of the panel (1).

The panel (1) is intended for use as part of a device for presenting information and has edges (4), each with at least a two-layer facing (5) applied on either the reverse (back) or the outer side of the panel (1) material in the pre-tensioned resiliently deformed state thereof and permanently affixed thereto with the ability to retain preliminary tension of the faced material of the panel (1) at the point of attachment.

The panel (1) can be made of any flexible material and is commonly made of textile material, or alternatively from non-shrink fabric or canvas.

The facing (5) can be composed of materials having not only certain elasticity, allowing it to roll up with the panel 1 material, but also of materials of significantly more rigidity compared to the panel (1) material, which allows for better preservation, during resilient deformation, of the panel (1) material where it attaches to the facing (5) (i.e., during assembly, preliminary tension of the panel (1) material at the edges (4) is maintained).

The facing (5) can be composed of, for example, polyvinyl chloride in several segments (102) (i.e. can be sectional and/or have gaps).

The facing (5) can preferably be glued to the panel (1) material using either quick-setting polyurethane thermal glue or another fast-setting glue with analogous properties, two-sided adhesive tape, high-frequency welding, or using any other known method.

The device for presenting information and frame for it operate as follows: The frame (2) is assembled on location and its segments are affixed. The panel (1) is applied to the frame (2) and the edges (4) act as levers-spacers; the panel (1) is tightened by rotation of the edges (4) under or on the ledges (3) at the ends of the frame (2). Pretension of the panel (1) material at the point of attachment to the facing (5) enables its installation on the frame (2) immediately in optimal tensioned state. The device for presenting information with a panel (1) attached to the frame (2) is ready for demonstration. If transportation of the device to a different location/area is required, the edges (4) fold in the opposite direction and the panel (1) dismantles from the frame (2) and is rolled up. The frame (2) is disassembled and its parts can be packaged along with the rolled up panel (1) in one container, ensuring its safety during transportation. At a new location, the device assembly is analogous.

During operation: (a) the edges (4) along the sides of the panel (1) are reused and preserved; (b) the edges (4) function as levers-spacers when tensioning the panel (1) to the frame (2); (c) the edges (4), after stretching the panel, serve to affix the panel (1) onto the frame (2); (d) the edges (4) move to the reverse (back, rear) side of the panel (1) material after tensioning; therefore, they can be removed from the direct area of observation; (e) as a result of the panel (1) bending (after tensioning) around the edges (4) and ledge (3) of the frame, the stress (created due to stretching/affixing panel to the frame) is partially removed from the area of attachment of the panel (1) to the edges (4); (f) the perimeter of the edges (4) can be continuous or divided into chunks (i.e. segments); (g) the edges (4) can be flexible for rolling up the panel (1) during transportation and storage.

The grooves (6) increase the reliability of mounting the panel (1) to the frame (2) under conditions of strong wind or other forces.

For fastening the facing (5) to edge (4) of the panel (1), the following technology is available: during stationary production, the material of the panel (1) is stretched—the axial force F is applied to create the optimal required and sufficient tension, i.e. resilient deformation of the panel (1). In this condition, the facing (5) is fastened to the edge of the material of the panel (1), and only after this is the applied tensile force removed from the panel (1). This way, due to the more rigid facing (5), the edges (4) avoid deformation/de-tensioning of the sides of the panel (1) at the point of attachment. Additionally, operational tension is more easily achieved.

Figure 1:
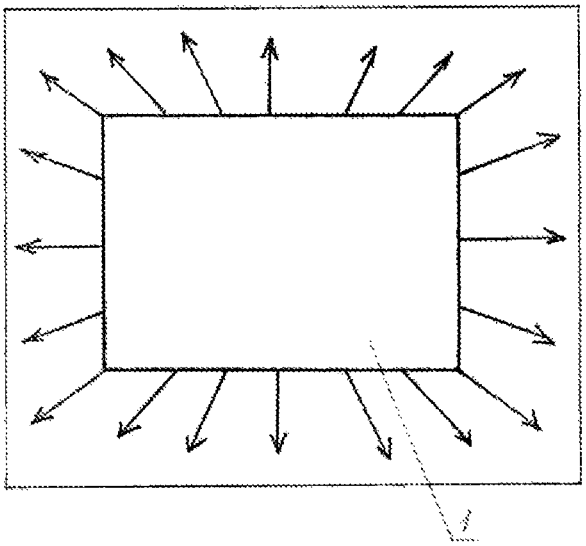
FIGS. 1 2, 3, and 6 show general schematics for applying force to panel material (1) during tensioning.

Tensioning of the perimeter/sides of the panel (1) is first achieved in the longitudinal direction. Then, deformation resistance of the panel (1) is achieved, due to the aforementioned tension between the stretched panel material (1) and the facing (5) applied thereto. Operational tension of the panel is achieved later on the frame (2) during installation. During on-site tensioning of the panel (1), it is not necessary to move every point on the side of the panel (1) in a direction away from the center (as displayed in FIG. 1) because the longitudinal expansion of the edge is already completed and held in place by the facing (5). This leaves only movement (expansion/stretching) of edges (4) in the lateral direction with force P. Simultaneously and automatically, the tension vectors of the panel (1) spread in proper directions to achieve optimal operational tension.

The tensioning throughout the panel (1) surface is due to the edge (4) (when tensioned) acting as a spacer between the frame (2) and the panel (1); and, as the edge (4) preserves the previously created longitudinal tension of the panel (1), the panel (1) stretches in both longitudinal and lateral directions.

The result is high quality, quick, and repeatable tensioning of the advertisement carrier during a long service life. There is no need for complex bulky equipment at the installation locations and complex operations for satisfactory tensioning of a panel for every frame installation. This results in a reduced need for qualified installation personnel and reduced labor costs while providing a high quality installation, as well as an increased number of possible use cycles, i.e. durability. Also, it results in the ability to move the device multiple times, since every installation operation isn't associated with significant wearing of the panel and frame. This invention thus provides a high quality, uniform tensioning of the panel for a device for presenting information (e.g. an advertisement carrier).

This invention ensures high quality, quick, and repeatable tensioning of the advertisement carrier for a long service life. There is no need for the use of complex, bulky and unreliable specialized equipment, or for implementation of time-consuming and labor-intensive operations for tensioning the panel for every frame installation. This results in the reduced need for qualified installation personnel and reduced labor costs associated with transportation and installation, while ensuring high quality tensioned panel installations. Provided is a high quality, uniform tensioning of the panel of the device for presenting information—in particular, decorative and/or advertisement carriers.

The present invention is implemented using modern equipment available in the industry.

It will be understood by those skilled in the art that various changes in form and details may be made therein without departing from the spirit and scope of the invention as set forth in the appended claims. Those skilled in the art will recognize, or be able to ascertain using no more than routine experimentation, many equivalents to the specific embodiments of the invention described herein. Such equivalents are intended to be encompassed in the scope of the claims.

What is claimed is:

1. A device for presenting information, comprising a panel and a multipart frame, wherein said panel is mounted on the sides of said multipart frame by panel's bendable edges; and wherein each of the bendable edges is an at least two-layered structure comprising the panel itself and a facing affixed to one side of the bendable edge of the panel in a pre-tensioned resiliently deformed state, thus retaining the longitudinal tension of said edge material attached to the facing; and said panel is mounted on said multipart frame in a state of resiliently extended deformation and affixed to said frame by said edges, supported in pairs on the frame.

2. The device according to claim 1, wherein edges are positioned at an angle to the panel surface.

3. The device according to claim 2, wherein the frame has a ledge along the edges to allow for hemming of the edges on the back or front side of the panel.

4. The device according to claim 2, further comprising parallel ledges and grooves on the frame sides, wherein said sides' outer edges are separated by a distance which is less than the width of the edge of the panel.

5. A panel for the device for presenting information-according to claims 1, wherein the edges have an at least two-layered structure in the form of a facing applied to the edge material of the panel in its pre-tensioned resiliently deformed state and affixed thereto whilst retaining the tension of the facing material of the panel at a fixing point, wherein the facing material is harder compared to the panel's material.

6. The panel according to claim 5, wherein said facing applied to the back or front sides of the panel material is comprised of a grooved material, and such grooves function as levers-spacers and clamps during tensioning of the panel on the frame.

7. The panel according to claim 5, wherein said facing is continuous.

8. The panel according to claim 5, wherein said facing is attached to the panel material with quick-setting thermal glue, two-sided adhesive tape, or high-frequency welding.

9. The device according to claim 6, wherein said facing is attached to the panel material with quick-setting thermal glue, two-sided adhesive tape, or high-frequency welding.

10. The device according to claim 6, wherein said facing is continuous.

11. The device according to claim 1, further comprising a frame with a ledge along the edges to allow for hemming of the edges on the back or front side of the panel.

12. The device according to claim 1, further comprising parallel ledges and grooves on the frame sides, wherein said sides' outer edges are separated by a distance which is less than the width of the edge of the panel.

* * * * *